US008292029B2

(12) United States Patent
Martin

(10) Patent No.: US 8,292,029 B2
(45) Date of Patent: Oct. 23, 2012

(54) SECURING RING AND CORRESPONDING MANUFACTURING PROCESS

(75) Inventor: Ian Martin, Squamish (CA)

(73) Assignee: Arc'Teryx Equipment Inc., North Vancouver, B.C. (CA)

( * ) Notice: Subject to any disclaimer, the term of this patent is extended or adjusted under 35 U.S.C. 154(b) by 1147 days.

(21) Appl. No.: 11/939,156

(22) Filed: Nov. 13, 2007

(65) Prior Publication Data

US 2008/0229558 A1 Sep. 25, 2008

(30) Foreign Application Priority Data

Mar. 13, 2007 (EP) ..... 07005092

(51) Int. Cl.
*A62B 35/00* (2006.01)

(52) U.S. Cl. ..... 182/3; 182/6; 182/7; 119/907

(58) Field of Classification Search ..... 182/3, 4, 182/6, 7, 9; 2/209.11, 319, 69, 155, 309; 119/907

See application file for complete search history.

(56) References Cited

U.S. PATENT DOCUMENTS 3,185,362 A * 5/1965 Wakefield ..... 224/155
3,237,210 A * 3/1966 Graber ..... 2/209.11
3,445,055 A * 5/1969 Port et al. ..... 383/32
3,470,928 A * 10/1969 Schwartz ..... 383/117
3,757,893 A * 9/1973 Hobbs ..... 182/6
3,766,566 A 10/1973 Tadokoro
4,641,380 A * 2/1987 Epstein ..... 2/209.11
4,937,885 A * 7/1990 Gregg ..... 2/209.11
5,088,128 A * 2/1992 Kape ..... 2/269
5,309,574 A * 5/1994 Balaban et al. ..... 2/202
5,455,970 A * 10/1995 Vance et al. ..... 2/171.04
5,566,871 A * 10/1996 Weintraub ..... 224/264
6,026,514 A * 2/2000 Fricker ..... 2/209.11
6,050,364 A * 4/2000 Popall et al. ..... 182/6
2007/0209869 A1 9/2007 Martin et al.

FOREIGN PATENT DOCUMENTS

FR 1 187 369 A 9/1959
FR 2 857 879 A1 1/2005
GB 1 020 838 A 2/1966

* cited by examiner

*Primary Examiner* — Alvin Chin Shue
*Assistant Examiner* — Colleen M Chavchavadze
(74) *Attorney, Agent, or Firm* — Greenblum & Bernstein, P.L.C.

(57) ABSTRACT

A securing ring, such as a belay loop, including a plurality of layers of ring-shaped surface sections, an outermost ring-shaped surface section being fixed to at least one of the layers below. The ring-shaped surface sections are formed from surface sections of a flat tubular element folded or rolled upon one another. A corresponding process for the manufacture of the securing ring involves the folding or rolling up of a flat tubular element.

30 Claims, 6 Drawing Sheets

X 18
13
10
12
15
11
15
20
A
14
16

SECURING RING AND CORRESPONDING MANUFACTURING PROCESS

CROSS-REFERENCE TO RELATED APPLICATION

This application claims priority under 35 U.S.C. §119 of European Patent Application No. 07 005092.7, filed on Mar. 13, 2007, the disclosure of which is hereby incorporated by reference thereto in its entirety.

BACKGROUND OF THE INVENTION

1. Field of the Invention

The present invention relates to securing rings, a method of manufacturing the same, and harnesses comprising such securing rings. In particular, the invention is concerned with, but not limited to, belay loops for climbing harnesses, as well as a climbing harness which is equipped with a belay loop.

2. Description of Background and Other Information

Belay loops for climbing harnesses are well known. Such a loop functions as a connector between the leg loops and the waist band, also known as a "swami" belt, of the harness, thereby maintaining the leg loops to the waist band and vice versa.

A typical belay loop is disclosed in French patent application FR 2 857 879. The disclosed belay loop consists of flat webbing sewn into a circular shape. The loop thus formed has one or more wraps and a final outer overlap, where it is sewn together for structural integrity.

Because belay loops known in the prior art are flat, they tend to have hard edges which cause abrasion at the tie-in points of the harness. In addition, the area where the overlap is sewn to the underlying wraps is even harder because of the stitching, causing further points of abrasion.

Furthermore, the strength of these known belay loops is limited by the strength of the seam between the overlap and the underlying wraps, since such seam is subjected to stresses during use of the harness.

SUMMARY OF THE INVENTION

The present invention provides an improved securing ring. More particularly, the present invention provides a securing ring and, in a particular application of the invention, a belay loop, that is stronger than prior securing rings, such as those described above. The securing ring of the invention, particularly the belay loop application of the invention, provides for a reduced abrasion at the tie-in points.

The securing ring of the invention comprises several layers, or at least a plurality of layers, of ring-shaped surface sections, the outermost ring-shaped surface section being fixed to at least one of the layers below, the ring-shaped surface sections being formed from surface sections of a flat tubular element folded or rolled upon one another.

The securing ring according to the invention includes a tubular element that has been folded up upon itself. One may also say that the tubular element has been partially turned inside out, i.e., everted, several times from one of its open ends to the other. The tubular element may also be described as being rolled up upon itself, the term "rolling" being more appropriate in the case of a very tight folding.

Due to the inventive geometry of the securing ring, i.e., a "folded up" flat tubular element instead of a wound up flat strap of webbing as known from the prior art, the hard edges of the strap are substituted by softer folds, which reduces abrasion during use.

The inventive geometry also leads to a stronger securing ring, as the old seam that limits the strength of the known rings is no longer present.

In a particular implementation of the invention, the ring-shaped surface sections extend around the entire circumference of the ring and form a closed loop, i.e., the two ends of each surface section meet and merge to form the ring shape.

In another particular implementation of the invention, the ring-shaped surface sections are layered or stacked in such a way that a cross section of the resulting structure has the shape of a spiral and, in a particular example, a flattened spiral.

In a particular embodiment, the ring-shaped surface sections merge into one another along the circumference of the securing ring.

According to an aspect of a particular embodiment, the securing ring is made of braided material, such as a bi-axially braided material. The braided material may comprise nylon, liquid crystal polymer, polyester and/or polyethylene fibers. Particular examples of materials for the fibers are materials sold under the names of Vectran®, Spectra®, and Dyneema®. The invention, by incorporating such materials, provides a strong yet supple loop, with no hard abrasion points.

It has been found that the invention can be advantageously implemented with the use of braided material of at least two different types of fiber made of different materials.

In a particular embodiment, the outermost ring-shaped surface section has an edge running along the circumference of the securing ring, the outermost ring-shaped surface section being fixed by securing such edge to the ring. Such edge can be secured by lamination or stitching.

The invention also includes a process for the manufacture of a securing ring.

The inventive process includes the following:

- cutting a flat tubular braid material to a predetermined length to obtain a flat tubular element;
- expanding the tubular element using a form;
- starting from a first circumferential edge of the tubular element, folding or rolling surface sections of the tubular element upon one another along the axial direction of the tubular element up to the second circumferential edge of the tubular element to create a ring shape;
- securing the second circumferential edge to the created ring shape, in particular by lamination or stitching.

In a particular embodiment, the inventive process additionally comprises adding adhesive to the two circumferential edges after the expansion of the tubular element and before the folding or rolling.

The invention also covers a harness that includes an inventive securing ring as described above.

BRIEF DESCRIPTION OF THE DRAWINGS

The following is a description of a preferred non-limiting embodiment of the inventive securing ring and process. The description is illustrated by the accompanying drawings, in which.

DETAILED DESCRIPTION OF THE INVENTION

Figure 1:
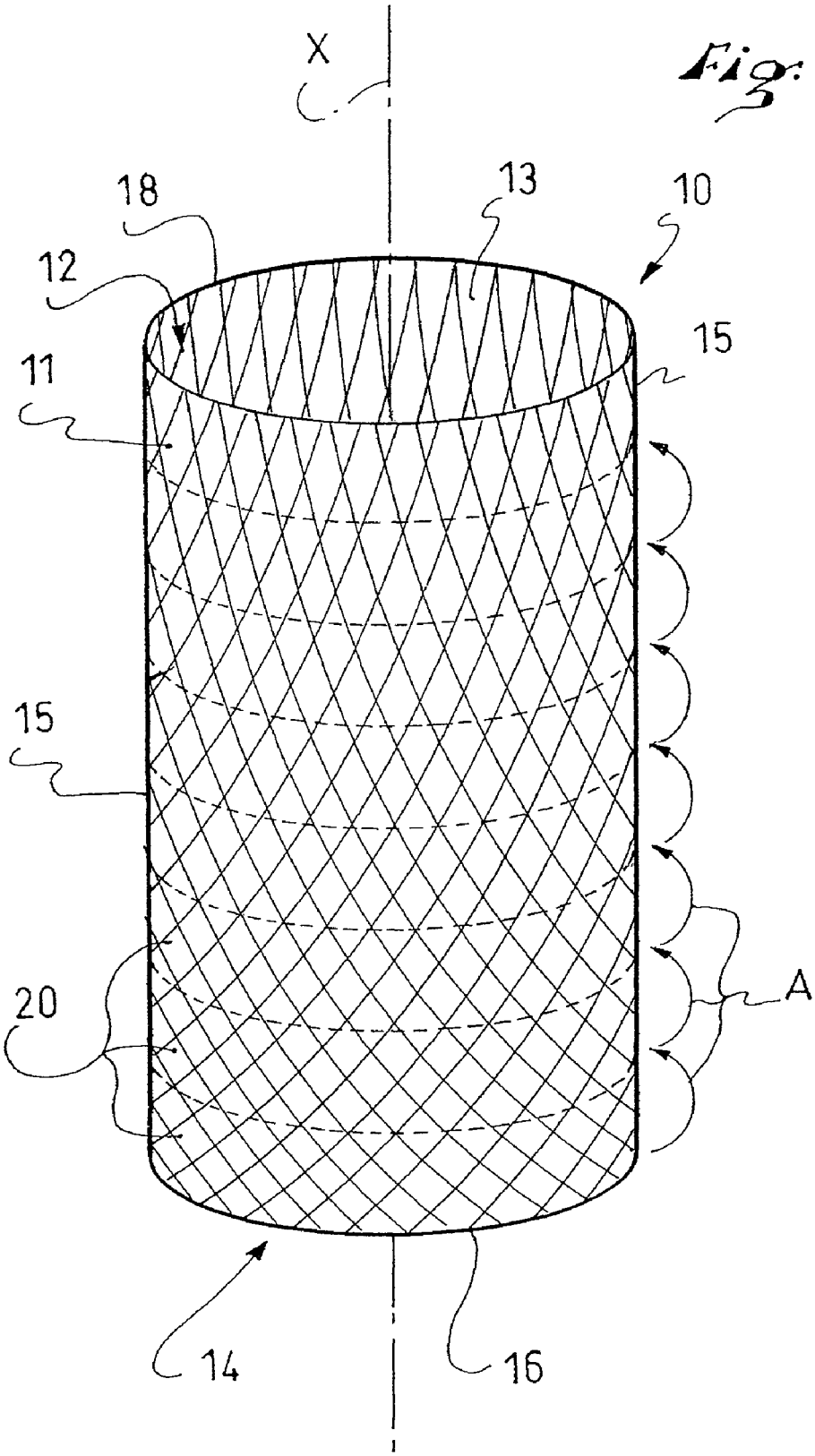
FIG. 1 is a perspective view of a tubular element used for creating a securing ring according to the invention.

FIG. 1 generally shows a flat tubular element 10. The tubular element 10 is in the form of a flattened sleeve with two open ends 12 and 14 and two superimposed sheets 11 and 13, the sheets merging at two folds 15. The open ends 12 and 14 are surrounded by a first, lower circumferential edge 16 and a second, upper circumferential edge 18.

The tubular element 10 is orientated along an imaginary longitudinal axis X. The tubular element 10 may be envisioned as a succession of ring-shaped surface sections 20, which are indicated by the broken lines in FIG. 1. It is to be noted that the surface sections 20 do not correspond to physically delimited subdivisions of the tubular element 10. Rather, they represent conceptual delimitations that are introduced to explain more easily how the tubular element 10 is folded into the securing ring 22, shown in FIG. 2.

Each surface section 20 corresponds to a closed flattened ring running along the surface of both sheets 11 and 13 and around axis X.

The tubular element 10 is made of bi-axially braided material, as indicated in the drawing by cross-hatching. The material can be nylon, polyester, liquid crystal polymer, polyethylene or any other material that is at the same time soft, supple, and strong, particularly soft, supple and strong in the context of the use disclosed herein. The bi-axial braid may be formed by a single type of fiber or several types of fiber.

Due to the bi-axial braiding, the tubular element 10 does not include a longitudinal or transverse seam, i.e., no seam extending along a direction parallel to or perpendicular to the axis X.

Figure 2:
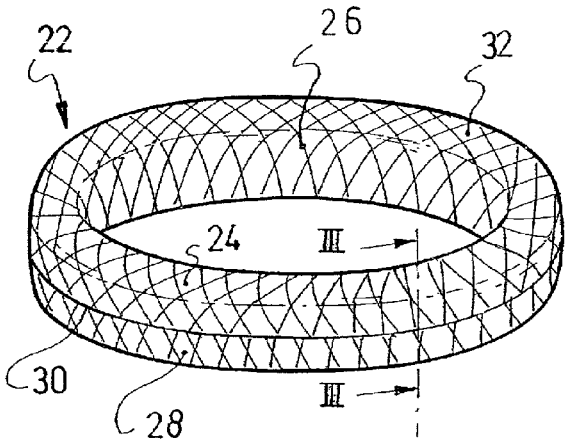
FIG. 2 is a perspective view of a securing ring of the invention.
Figure 10:
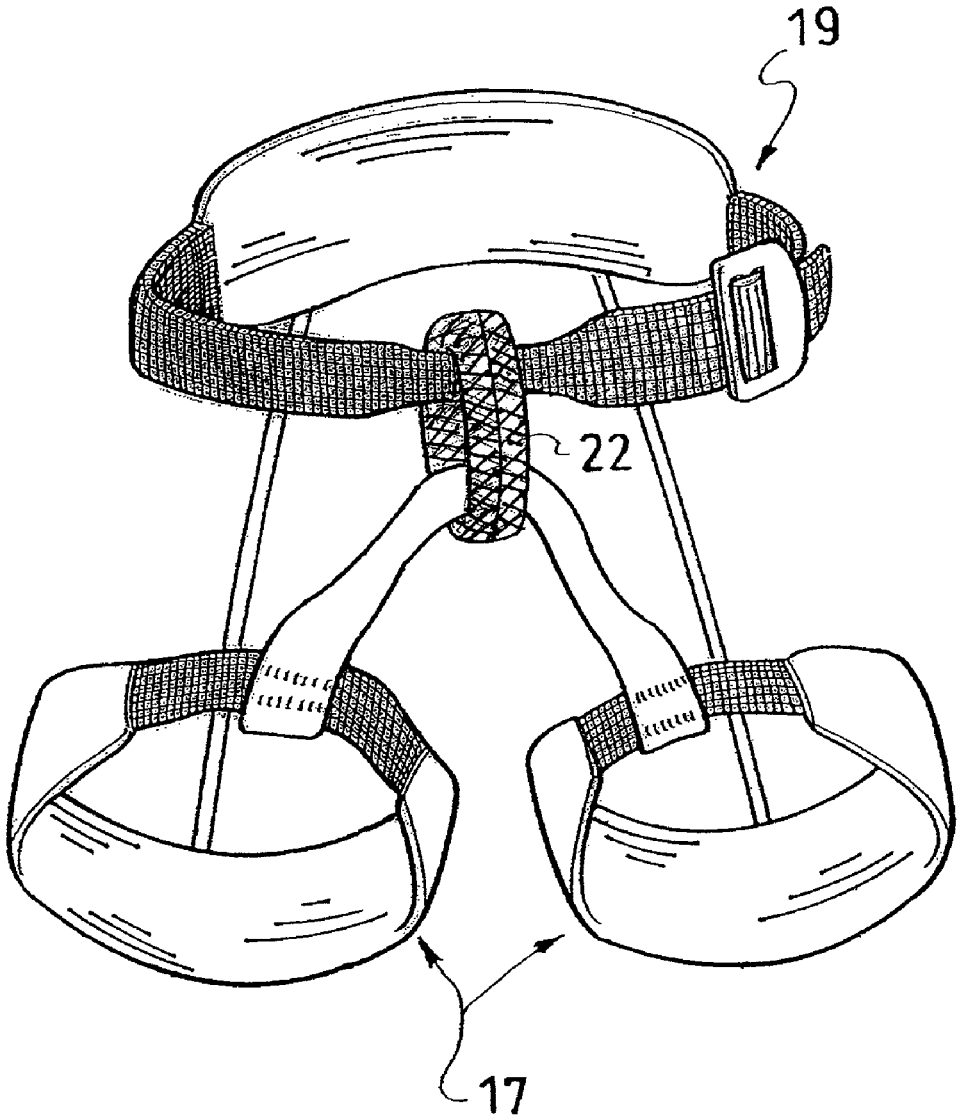
FIG. 10 is a schematic perspective view of a climbing harness equipped with a belay loop, constructed according to the invention.

With reference to FIG. 2, a securing ring is generally shown at 22. Securing ring 22, which can also be regarded as a load-bearing ring, can represent a belay loop for a climbing harness but may also be used for other securing and load-carrying purposes. FIG. 10 illustrates a climbing harness like that disclosed in commonly owned U.S. Patent Application Publication No. 2007/0209869, the disclosure of which is hereby incorporated by reference thereto in its entirety, modified to be equipped with a securing ring 22 (i.e., a ring such as shown in FIG. 2), used as a belay loop joining the leg loops 17 to the waist band 19. The details of the various components of the load-bearing device/harness shown in FIG. 10, such as the waist band 19, the leg loops 17, and the link strap connecting the leg loops, are exemplary, the securing ring 22 being suitable for use in other load-bearing devices and harnesses.

Securing ring 22 is obtained by everting the surface sections 20 of tubular element 10, starting from the lower edge 16, progressing axially along axis X of the tubular element 20, and ending at the upper edge 18, as indicated by arrows A in FIG. 1.

Securing ring 22 is obtained by everting the surface sections 20 of tubular element 10, starting from the lower edge 16 and ending at the upper edge 18, as indicated by arrows A in FIG. 1.

The overall surface of securing ring 22 includes an inner ring-shaped surface section 26, an outer ring-shaped surface section 28, and an outermost ring-shaped surface section 24. The surface section 24 partially overlaps the outer surface section 28 and is secured to the latter via its circumferential edge 30.

Each surface section 24, 26, and 28 corresponds to one of the surface sections 20 of the tubular element 10.

As the securing ring 22 is a "folded up" version of tubular element 10, it consists of the same braided material 32.

Figure 3:
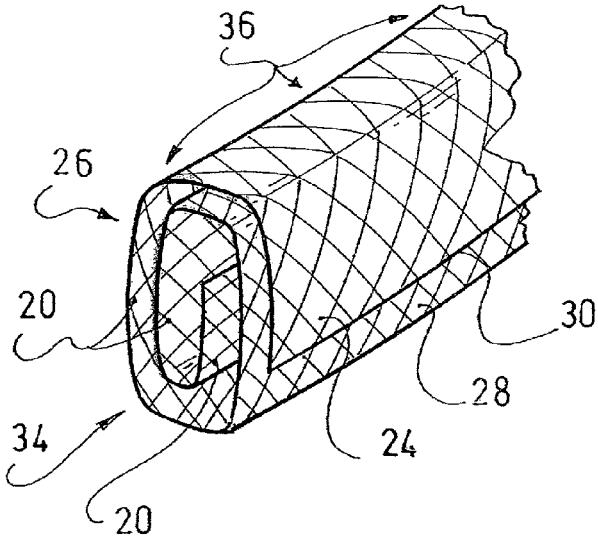
FIG. 3 is a perspective cross-sectional view along the lines of FIG. 2.
Figure 3A:
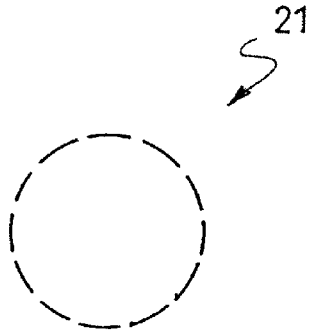
FIG. 3*a* is schematic view, indicative of a substantially round spiral cross section of a ring, according to a variation of a flattened spiral shown in FIG. 3.

FIG. 3 gives an enlarged perspective cross-sectional view of securing ring 22. As can be seen from the figure, the inner structure of the ring 22 has the cross-sectional shape of a flattened spiral 34. The ascending and descending parts of the spiral correspond to the folded surface sections 20 of the tubular element 10. In the case of a very tight fit or a tight rolling of the tubular element 10, the flattened spiral 34 may approach an ideal round spiral 21, schematically represented in FIG. 3*a*.

As can be seen from FIG. 3, the outermost surface section 24 merges into the inner surface section 26 along the circumference 36 of the securing ring 22. The edge 30 of the outermost surface section 24 is fixed to the outer surface section 28 by lamination or stitching.

The process for the manufacture of securing ring 22 will now be described with reference to FIGS. 4 to 9.

Figure 4:
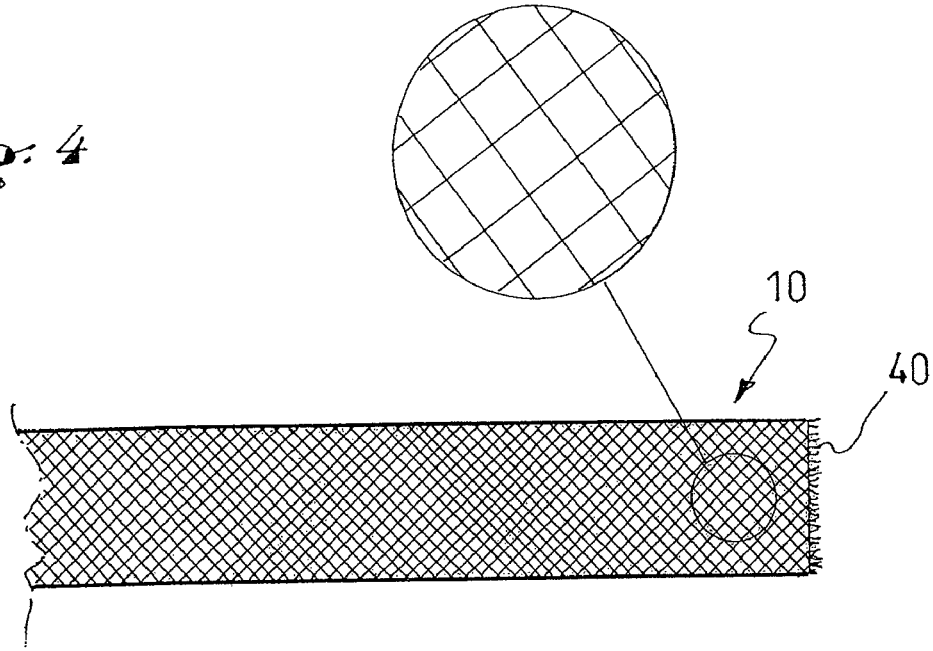
FIGS. 4 through 9 are illustrations of different stages of a manufacturing process according to the invention.

The process starts with a flat tubular braid material that is cut to a desired length to form the flat tubular element 10. FIG. 4 shows the result of such cutting.

Figure 5:
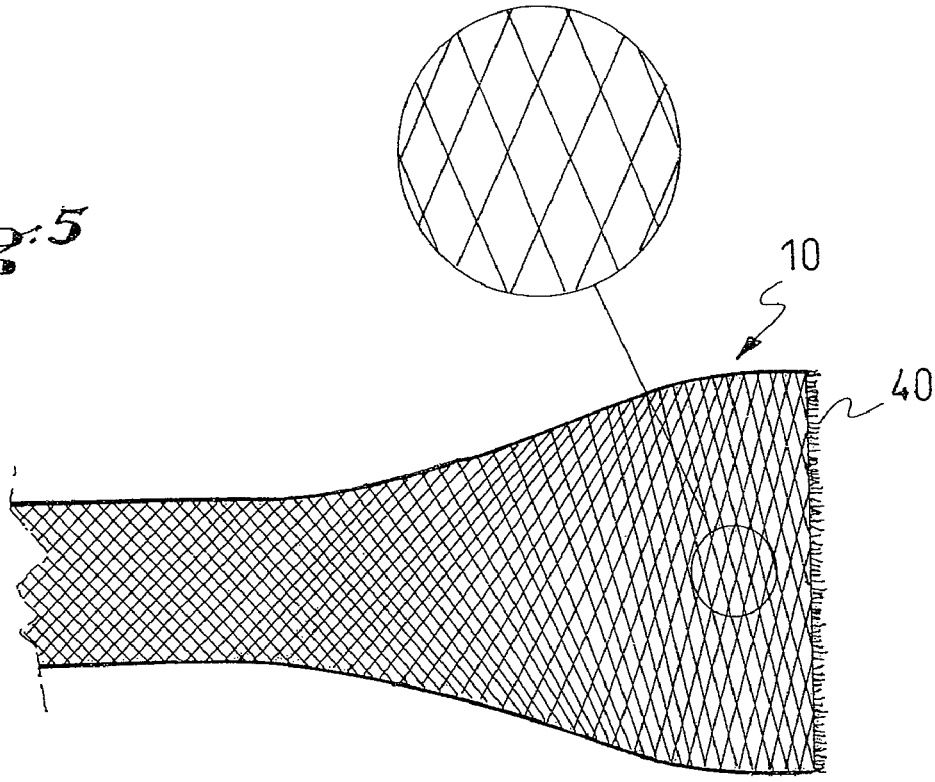
Figure 6:
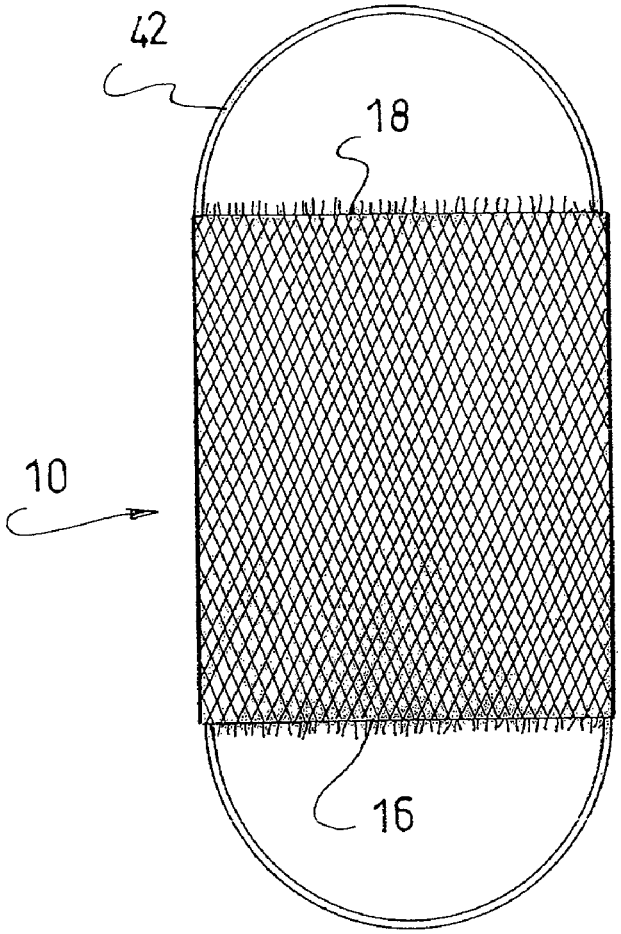

After the cutting, the tubular element 10 is partially expanded at one of its open ends to create an opening 40, as shown in FIG. 5. The opening 40 is needed to permit insertion of a form 42 (cf. FIG. 6). FIG. 6 shows the tubular element 10 as it has been expanded by inserting the form 42.

It is to be noted that although the braid is cut in its natural, unexpanded form, it is cut to a measured length it would have when it is in the expanded form. Indeed, the expansion of the braid shortens the length of the braid while increasing its width.

The form 42 can be made by a loop of a cable that is sufficiently rigid to maintain the tubular element 10 in expansion.

After the tubular element 10 has been expanded, the form 42 is removed. The lower and upper circumferential edges 16, 18 of the tubular element 10 may then optionally be stabilized by adding adhesive thereto.

Figure 7:
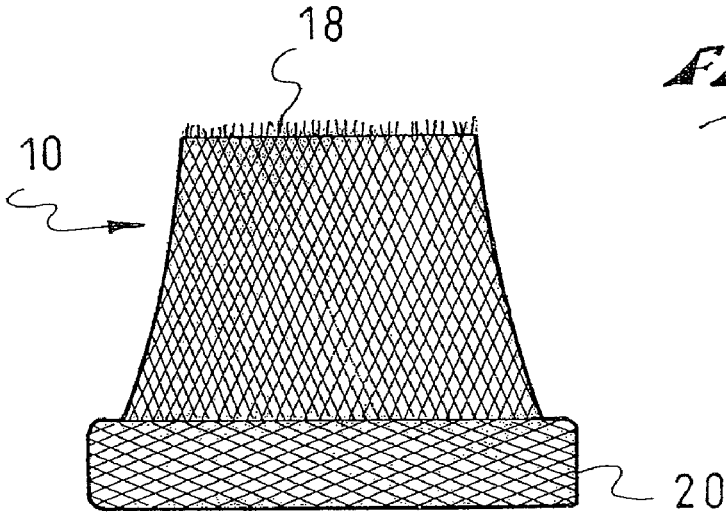
Figure 8:
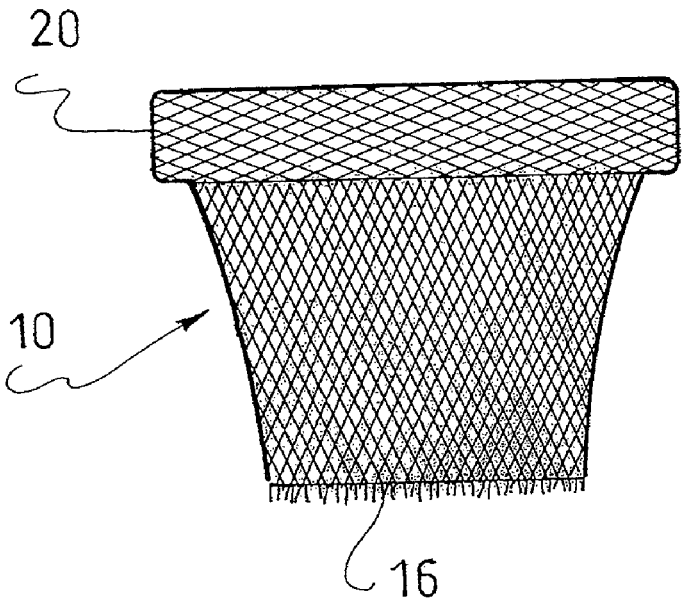

Next, the tubular element 10 is "folded up." This is shown in FIGS. 7 and 8. The braid is folded several times along the direction of axis X in line with the conceptual surface sections 20 (cf. FIG. 1). The folding may be started from the lower circumferential edge 16, as shown in FIG. 7, or it may be started from the upper circumferential edge 18, as shown in FIG. 8. The folding ends on the opposite edge to create a ring shape.

Depending on the type of braid material used, the folding may instead be a rolling up of the braid from one circumferential edge 16, 18 to the other 18, 16.

Figure 9:
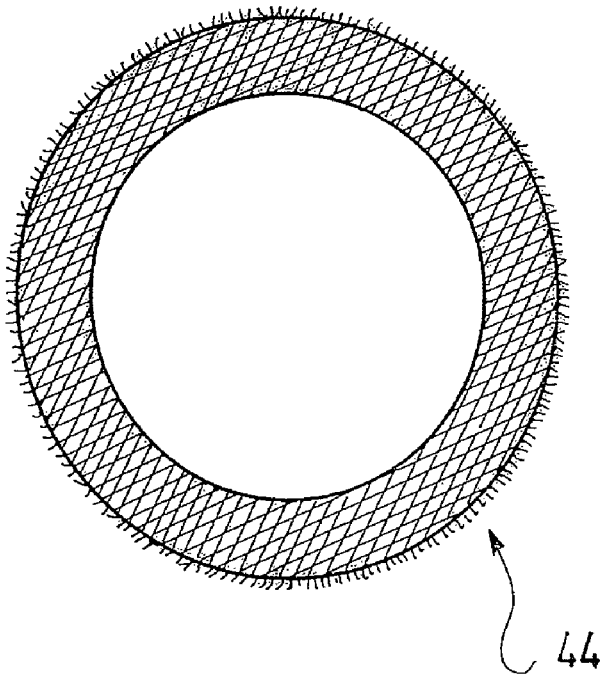

FIG. 9 shows the final ring shape 44 after the folding or rolling.

Whether folded or rolled, the ring 22 includes at least a plurality of layers, as described above. The exemplary illustration of FIG. 3 shows the ring 22 as having five layers in a cross section perpendicular to longitudinal axis X of FIG. 1. The plurality of such layers can vary within the scope of the invention, such as being within a range of from three through six, or from three through up to as many as ten or more. In a particular range of embodiments, which also encompass that shown in FIG. 3, the number of layers can be within a range of from five through seven. A greater number of layers would tend to ensure a greater strength for the securing, load-bearing ring 22. When used as part of a climbing harness, i.e., as a belay loop, e.g., the particular type of material used and the particular number of layers of the ring would be sufficient to support a weight of a climber, such as, e.g., from about 120 pounds (lbs.) to about 300 lbs. (i.e., from about 54 Kg. to about 136 Kg.).

Finally, in the manufacture of the securing ring 22, the outer circumferential edge 30 (cf. FIGS. 2 and 3; corresponds either to the lower or the upper circumferential edge 16 or 18, depending on where the folding or rolling was started) is either laminated or stitched to the remainder of the structure.

Tests have been completed to show that the manufacturing process of the invention creates a very strong structural loop that could be used as a link in many types of applications.

The securing ring of the invention is soft and supple, yet strong. When it is used as a belay loop for a climbing harness, it gives the climber a sense of wearing no harness at all. In addition, it allows the life of the harness to be extended inasmuch as abrasion is reduced.

Because the securing ring of the invention is not like it was in the prior art, i.e., a flat "ribbon-type" annulus but, as shown in FIG. 2, e.g., the ring of the invention has a torus shape, or a torus-like shape; no angular edges are provided. Considering axis X of FIG. 1 extending through the ring shown in FIGS. 2 and 3, there are no angular axially facing edges. Further, the radially inner surface 26 of the ring extends itself continuously up to the radially outer surface 24 of the ring, i.e., from the inner surface 26, around the axially facing soft edges, to the outer surface 24. Further, the inner surface 26 of the ring and the soft edges are devoid of any seam.

Applications of the inventive securing ring are not limited to climbing harnesses. The securing ring may be used anywhere one needs a soft, supple, and strong securing link or load-bearing link. For example, the securing ring may be used in the context of industrial lifting. In this regard, the securing ring can be used with soft slings.

The invention claimed is:

1. A securing and load-bearing ring comprising:
several layers of ring-shaped surface sections;
said sections comprising an outermost ring-shaped surface section fixed to at least another of said sections below;
said ring-shaped surface sections being formed from surface sections of a flat tubular element folded or rolled upon one another thereby to form the securing and load-bearing ring;
said securing and load-bearing ring having a strength to support a weight of at least about 120 lbs.

2. A securing and load-bearing ring according to claim 1, wherein:
the ring-shaped surface sections merge into one another along a circumference of the securing ring.

3. A securing and load-bearing ring according to claim 1, wherein:
the securing ring is made of bi-axially braided material.

4. A securing and load-bearing ring according to claim 3, wherein:
the braided material comprises nylon, liquid crystal polymer, polyester and/or polyethylene fibers.

5. A securing and load-bearing ring according to claim 3, wherein:
the braided material comprises at least two different types of fiber made of different materials.

6. A securing and load-bearing ring according to claim 1, wherein:
the outermost ring-shaped surface section has an edge running along the circumference of the securing and load-bearing ring, the outermost ring-shaped surface section being fixed by securing said edge to the ring.

7. A securing and load-bearing ring according to claim 6, wherein:
said edge is secured by lamination or stitching.

8. A securing an load-bearing ring according to claim 1, wherein:
said securing and load ring has a strength to support a weight of less than about 300 lbs.

9. A securing and load-bearing ring according to claim 1, wherein:
said several layers of ring-shaped surface sections comprise three or more layers.

10. A securing and load-bearing ring according to claim 1, wherein:
said several layers of ring-shaped surface sections comprise five, six, or seven layers.

11. A process for manufacturing a securing and load-bearing ring according to claim 1, said process comprising:
manufacturing the securing ring comprising:
cutting a flat tubular braid material to a predetermined length to obtain a flat tubular element;
expanding the tubular element using a form;
starting from a first circumferential edge of the tubular element, folding or rolling surface sections of the tubular element upon one another along an axial direction of the tubular element up to a second circumferential edge of the tubular element to create a ring shape;
securing the second circumferential edge to the created ring shape by means of lamination or stitching.

12. A process for manufacturing a securing and load-bearing ring according to claim 11, further comprising:
adding adhesive to the first and second circumferential edges after said expanding and before said folding or rolling.

13. A connecting or load-bearing device comprising:
a connecting or load-bearing ring comprising:
several layers of ring-shaped surface sections;
said sections comprising an outermost ring-shaped surface section fixed to at least another of said sections below;
said ring-shaped surface sections being formed from surface sections of a flat tubular element folded or rolled upon one another;
a load-bearing component in addition to the connecting or load-bearing ring.

14. A climbing harness comprising:
a waist band;
a pair of leg loops;
a belay loop joining the leg loops to the waist band, said belay loop comprising:
three or more layers of ring-shaped surface sections;
said sections comprising an outermost ring-shaped surface section fixed to at least another of said sections below;
said ring-shaped surface sections being formed from surface sections of a flat tubular element folded or rolled upon one another in a direction axial of the flat tubular element.

15. A securing and load-bearing ring according to claim 1, wherein:
the several layers of ring-shaped surface sections provide the securing and load-bearing ring with a spiral cross section.

16. A securing and load-bearing ring according to claim 1, wherein:

the several layers of ring-shaped surface sections provide the securing and load-bearing ring with a substantially round spiral cross section.

17. A securing and load-bearing ring according to claim 1, wherein:

the securing and load-bearing ring has a torus shape.

18. A securing and load-bearing ring according to claim 1, wherein:

the securing and load-bearing ring extends continuously and is devoid of any seam from a radially inner surface, around an axially facing edge, to a radially outer surface.

19. A securing and load-bearing ring according to claim 1, wherein:

the ring-shaped surface sections are formed from surface sections of a flat tubular element folded or rolled upon one another in a direction axial of the flat tubular element.

20. A securing and load-bearing ring comprising:

several layers of ring-shaped surface sections;

said sections comprising an outermost ring-shaped surface section fixed to at least another of said sections below;

said ring-shaped surface sections being formed from surface sections of a flat tubular element folded or rolled upon one another thereby to form the securing and load-bearing ring;

the securing and load-bearing ring being a belay loop structured and arranged for use in a climbing harness.

21. A connecting or load-bearing device according to claim 13, wherein:

one of the additional components is a waist belt.

22. A connecting or load-bearing device according to claim 21, wherein:

the waist belt extends through the connecting or load-bearing ring.

23. A connecting or load-bearing device according to claim 21, wherein:

two of the additional components comprise a pair of leg loops.

24. A connecting or load-bearing device according to claim 23, wherein:

the waist belt is connected to the connecting or load-bearing ring and a link strap extends from one of the pair of leg loops to another of the leg loops, the link strap being connected to the connecting or load-bearing ring.

25. A connecting or load-bearing device comprising:

one or more components comprising a connecting or load-bearing ring comprising:

several layers of ring-shaped surface sections;

said sections comprising an outermost ring-shaped surface section fixed to at least another of said sections below;

said ring-shaped surface sections being formed from surface sections of a flat tubular element folded or rolled upon one another;

the connecting or load-bearing device being a harness.

26. A connecting or load-bearing device according to claim 13, wherein:

the several layers of ring-shaped surface sections provide the connecting or load-bearing ring with a spiral cross section.

27. A connecting or load-bearing device according to claim 13, wherein:

the connecting or load-bearing ring has a torus shape.

28. A connecting or load-bearing device according to claim 13, wherein:

the connecting or load-bearing ring extends continuously and is devoid of any seam from a radially inner surface, around an axially facing edge, to a radially outer surface.

29. A connecting or load-bearing device according to claim 13, wherein:

the ring-shaped surface sections are formed from surface sections of a flat tubular element folded or rolled upon one another in a direction axial of the flat tubular element.

30. A climbing harness according to claim 14, wherein:

the several layers of ring-shaped surface sections provide the securing ring with a substantially round spiral cross section.

* * * * *